United States Patent [19]

Wendt

[11] Patent Number: 4,567,706

[45] Date of Patent: Feb. 4, 1986

[54] EDGE ATTACHMENT CLIP FOR WALL PANELS

[75] Inventor: Alan C. Wendt, Barrington, Ill.

[73] Assignee: United States Gypsum Company, Chicago, Ill.

[21] Appl. No.: 519,867

[22] Filed: Aug. 3, 1983

[51] Int. Cl.[4] ..... E04B 1/38

[52] U.S. Cl. ..... 52/489; 52/361; 52/481; 52/714

[58] Field of Search ..... 52/357, 359, 360, 361, 52/481, 483, 489, 508, 509, 543, 553, 667, 714, 715, 580, 582, 583, 587; 24/543, 563

[56] References Cited

U.S. PATENT DOCUMENTS

| | | | |
|---|---|---|---|
| 2,282,631 | 5/1942 | Winship | 52/361 |
| 2,851,740 | 9/1958 | Baker | 52/489 |
| 2,880,481 | 4/1959 | Robinson | 52/582 |
| 3,020,602 | 2/1962 | Siering | 52/489 |
| 3,413,772 | 12/1968 | McCarthy | 52/677 |
| 3,553,919 | 1/1971 | Omholt | 52/489 |
| 4,263,764 | 4/1981 | Wendt | 52/481 |
| 4,377,060 | 3/1983 | Ragland | 52/481 |
| 4,467,579 | 8/1984 | Weinar | 52/281 |

FOREIGN PATENT DOCUMENTS

| | | | |
|---|---|---|---|
| 1059286 | 7/1979 | Canada | 52/489 |
| 1364686 | 5/1963 | France | 52/489 |
| 596993 | 8/1959 | Italy | 52/483 |

*Primary Examiner*—John E. Murtagh
*Assistant Examiner*—Andrew Joseph Rudy
*Attorney, Agent, or Firm*—Samuel Kurlandsky; Robert M. Didrick; Robert H. Robinson

[57] ABSTRACT

An integral clip for attaching wall panels to metal studs having flanges in engagement with the wall panels, the clip comprising impaling points adapted to be driven into the edge of a panel and additional impaling points adapted to be driven into a major surface of the panel for securing the clip to the panel, the clip also having flange attachment members struck from the clip and adapted to engage the flange of a stud, thereby affixing the panel to the stud.

6 Claims, 10 Drawing Figures

EDGE ATTACHMENT CLIP FOR WALL PANELS

BACKGROUND OF THE INVENTION (1) Field of the Invention

The present invention relates to building construction and more particularly concerns a perimeter or partition wall construction wherein wall panels are engaged at the edges thereof by substantially identical and interchangeable panel clips, and having integral means for being engaged with "H" shaped studs or "Z" splines having an engageable flange.

(2) Description of the Prior Art

The installation of gypsum, veneered gypsum, wood fiber or mineral fiber panels to the interior of perimeter, i.e., external and generally load-bearing walls is a widely used method of construction in residential, commercial and industrial applications to confer decorative esthetic or functional insulative properties upon the perimeter wall. Generally, the perimeter wall is composed of concrete, brick or other masonry precluding the direct attachment of a wall panel thereto; the desirability of installing vapor barrier or insulative materials between the wall panel and the perimeter wall, taken together with the difficulty in attaching the wall panel directly to the perimeter wall, have resulted in the industry-accepted construction comprising the first attachment of furring or studding by means of nailing or screwing the wall panels into surfaces of those supports subjacent the wall panels. With the appearance of perimeter wall systems of all types, the affixation of wall panels to subjacent supports by nail or screw attachment, followed by taping or plastering the abutting edges of the panels to conceal the nail or screw holes, has found less acceptance in the marketplace.

In attempts to obviate screw or nail attachment of panels to their support members in perimeter wall construction systems comprising unfinished, i.e., nondecorative, wall boards or gypsum boards and the taping or plastering attendant thereto, and to allow the attachment of veneered or pre-finished, i.e., decorative, wall boards or gypsum boards without unsightly fastener holes or material to cover those holes, many partition and perimeter wall construction systems utilize various studs, shims, clips and wall panel edge configurations in various combinations, and other components, to facilitate the installation of such perimeter wall panels without causing damage to abutting edges of the panels of the wall system. In providing for such convenient installation, many such systems require specially formed studs for the adaptive engagement of similarly specially formed panel engaging clips. Such studs have typically required particular openings or marginal or flange elements adapted for use, in turn, with particularly shaped clips. Other systems use conventional "I"-shaped or "J"-shaped studs or "Z"-shaped splines or channel-shaped studs, and provide for the facile installation of panels thereon through the use of clips fixedly engageable with the wall panel and with the stud or spline. These systems provide the sought for ease of installation, but such clips known in the prior art, when fixedly attached to the wall panel by the impalement of tines or prongs thereinto, often give rise to a major problem commonly known in the construction art as "pooching", i.e., an abnormal protrusion or distension or swelling of one or both of the covering or laminar layers of the wall panel. This defect takes the form of a blister or bubble in the exterior laminar layer caused either by the impaling tines diverging toward either surface of the panel or by the fracture or comminution and displacement toward the covering or laminar layer of the material of construction of the wall panel by the impaling tines or prongs. This problem is especially acute in veneered or pre-finished, i.e., decorative, wall panels, since no means exist to repair such a "pooching" defect when it occurs in the veneered or pre-finished decorative interior surface or laminar layer.

SUMMARY OF THE INVENTION

It is accordingly an object of the present invention to provide an economical and facile mounting system for such wall panels in both perimeter and partition wall construction which affords positive panel placement on that wall without destruction of, or damage to, any of the wall panel elements.

It is also an object of the invention to provide a wall mounting system wherein the panel mounting clips are interchangeable for use at either edge of the panel in mounting to subjacent support.

It is still further an object to provide an easily installed wall system wherein the defect of "pooching" does not occur.

Other objects and advantages of the invention will become apparent upon reference to the description below and to the drawings.

According to the invention, a perimeter or partition wall construction is provided in which the surface defect of "pooching" is eliminated and which comprises in combination a row of parallel aligned wall panels, adjoining panels meeting at the joints along marginal edges thereof. "Z"-shaped splines are fixedly attached to the perimeter wall or "H"-shaped flanged studs are disposed subjacent to the joints. Attachment clips provide for the edge engagement of the wall panels to the flanged surface subjacent and parallel to the occluded surface of the wall panels. The clip comprises, in its basic structure, an essentially planar portion adapted to be positioned in immediate juxtaposition to the occluded surface of the panel and adjacent the edge thereof to be attached to the flanged stud or spline. The clip further comprises first impaling points substantially parallel to the planar portion and depending therefrom by impaling point attachment means which are mutually perpendicular to the planar portion and to the impaling points. The clip further comprises stud flange attachment means comprising attachment members integral with the planar portion and extending therefrom adjacent to and projecting above the planar portion opposite the first impaling points, the attachment members being generally doubly arcuately formed in first being upwardly arcuate proximal the planar portion and downwardly arcuate distal to the planar portion, the proximate arcuation being substantially greater in radius than the distal arcuation. As a result the stud flange attachment means are formed to receptively frictionally engage the stud flange. The clip further comprises second impaling points extending from the edge of the planar surface opposite the edge thereof from which extend the aforesaid first impaling points and the aforesaid flange engagement means, the second impaling points extending initially angularly from the edge of the planar portion in a first section thereof integral with the planar portion and attached to a second section thereof perpendicular to the planar portion prior to impalement of the second portion into the occluded surface of the wall panel. As a result, after driving or finishing the second impaling points into the occluded surface of the wall panel, a configuration results wherein the pointed tip of the impaling point is more proximal the edge of the wall panel than the intersection of the first and second sections of the impaling point. In the attachment of the flange attachment member by the first impaling points to the edge of the wall panel, and in driving or finishing the second impaling points into the occluded surface of the wall panel, minimal disrupture, fracture and displacement of the material of composition of the wall panel occurs; "poochng" or the creation of undesirable surface distensions is obviated.

The objects and goals of this invention are further attained by providing an attachment clip as disclosed herein which will function properly in the economic and facile installation of wall panels of gypsum, veneered gypsum, wood fiber or mineral fiber from three-eighths of an inch to one inch thick; typically, two or more of these clips are applied to each panel edge when securing the panels to the subjacent flange of the "I"-, "J"-, or "Z"-shaped stud or spline when the studs or splines are installed in vertical array twelve to thirty inches on center.

DESCRIPTION OF THE PREFERRED EMBODIMENTS

Figure 1:
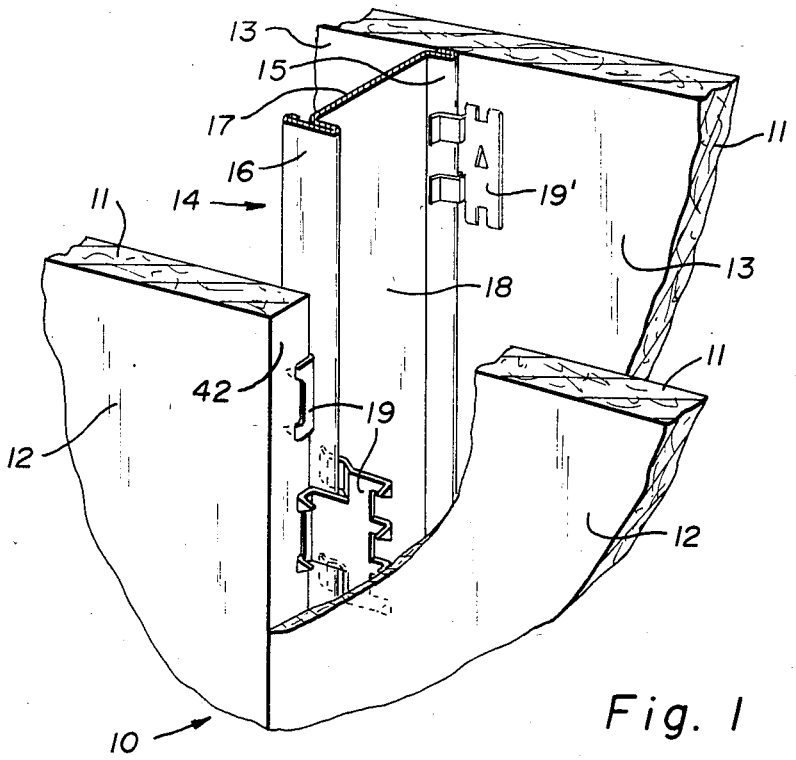
FIG. 1 is a perspective view of a portion of a hollow-wall partition construction with two panels at a joint, with a "J"-stud subjacent thereto.

Referring to FIG. 1, a typical partition wall 10 is shown at the joint location, partially broken away, to illustrate an embodiment of the invention. Partition wall 10 comprises two spaced-apart rows of panels 11 having exterior surfaces 12 providing the exposed or finished surfaces of the panels at the room side of the partition wall, and having interior or occluded surfaces 13 as shown on the opposite side of the panels 11 in the hollow portion of the partition wall 10. As used herein in the specification and claims, the term "occluded" means the interior or hidden surfaces of the wall panels, as designated by the numeral "11", as opposed to the exterior surfaces designated by the number "12". At the typical joint shown in FIG. 1, studs 14 are provided in a generally "J"-shaped configuration. Single and double flanges 15 and 16, respectively, reside subjacent to and parallel with the intermediate portion and the edge portion, respectively, of interior surfaces 13 and terminate in free ends 17. Single and double flanges 15 and 16 are integrally connected by a web 18.

Figure 3:
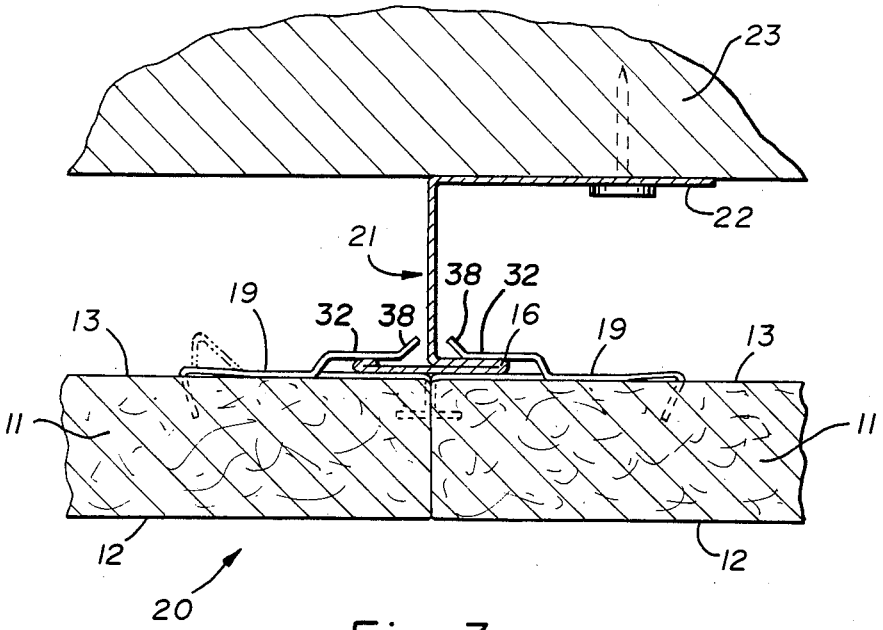
FIG. 3 is a top section view of the perimeter wall construction taken at the line 3—3 of FIG. 2, looking in the direction of the arrows.
Figure 4:
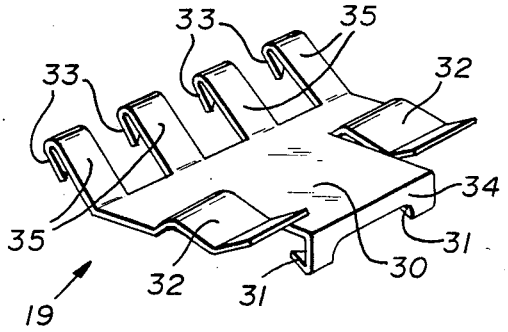
FIG. 4 is a perspective view of the panel edge stud clip of the invention in the bare or uninstalled position.
Figure 5:
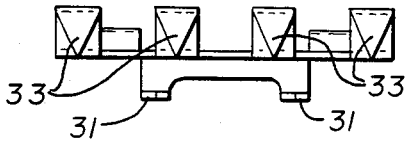
FIG. 5 is an elevational view of the edge clip of the invention, showing the impaling points adapted for impalement into the occluded wall board surface in the bare or uninstalled position.
Figure 6:
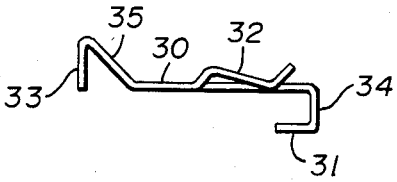
FIG. 6 is a side elevational view of the edge clip of the invention in the bare or uninstalled position.
Figure 7:
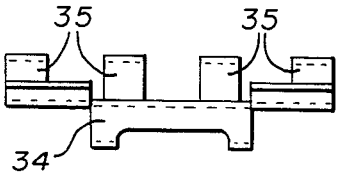
FIG. 7 is an elevational view of the edge clip of the invention opposite that shown in FIG. 5.
Figure 8:
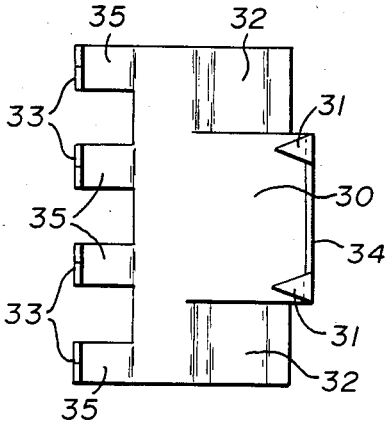
FIG. 8 is a bottom plan view of the edge clip of the invention in the bare or uninstalled position.

Attached to the interior or occluded surface 13 of panels 11, panel stud edge clips 19 are shown in the installed or finished position engaging panels 11 to double stud flange 16. Erection of partition wall 10 is first commenced by impaling with a smart hammer blow the first impaling points 31 of stud edge clip 19, i.e., those impaling points parallel to the planar portion 30 of the clip, into the vertical edges 42 of a panel to be installed therein, while insuring that the planar portion 30 of the clip 19 (FIGS. 3 and 4) is in immediate juxtaposition to the occluded surface 13 of wall panel 11. Next, the second impaling points 33 of clip 19 are impaled into the occluded surface 13 of panel 11 to provide the entire fixed attachment of clip 19 to wall panel 11. At least two of the stud attachment clips are required per vertical edge. The actual number of clips 19 to be applied to each vertical edge will, of course, be a function of the height, weight and material composition of the wall panel, as well as the spacing of studs 14 on-center, and will be well within the skill and knowledge of one skilled in the wall construction art. Having provided a predetermined number of stud clips at predetermined intervals along each such vertical edge, the number of clips installed being a function of the weight and bulk of the panel 11, a first panel is then horizontally slidably engaged with the first stud flange 16 which is received by arcuate stud flange attachment members or means 32 of clip 19 thereupon (FIGS. 3 and 4). Should a panel 11 require the subjacent support of more than one "J"-shaped stud, making necessary the employment of intermediate attachment clip 19' to engage flange 15 of stud 14, clips 19' may be attached at appropriate intervals upon the occluded surface 13 of the first panel in opposed parallel array not having double flange 16 of sheet 14 subjacent an edge thereof along the dimension on-center between adjacent "J"-shaped studs. With the secure engagement of the clips 19 placed at the edge of the panels with the flanges of the studs positioned at the ends of the panels, and the placement of the intermediate or field clips 19' engaging field-positioned studs, the panels are securely affixed to the studs upon sliding movement of the panel. The clips 19' are designed for attaching the field or middle portion of a panel to the flange of a stud, and are the subject matter of a concurrently filed application of the present inventor. The remaining unattached edge of panel 12 may then be fixedly secured in the perimeter wall to a subjacent stud 14 by now placing that stud into vertial position thereby engaging a trailing edge of flange 16 with the arcuate clip portion of the stud clips previously affixed to that remaining panel edge. The major characterized feature of this invention is the ease of installation of individual panels in a wall array.

Figure 2:
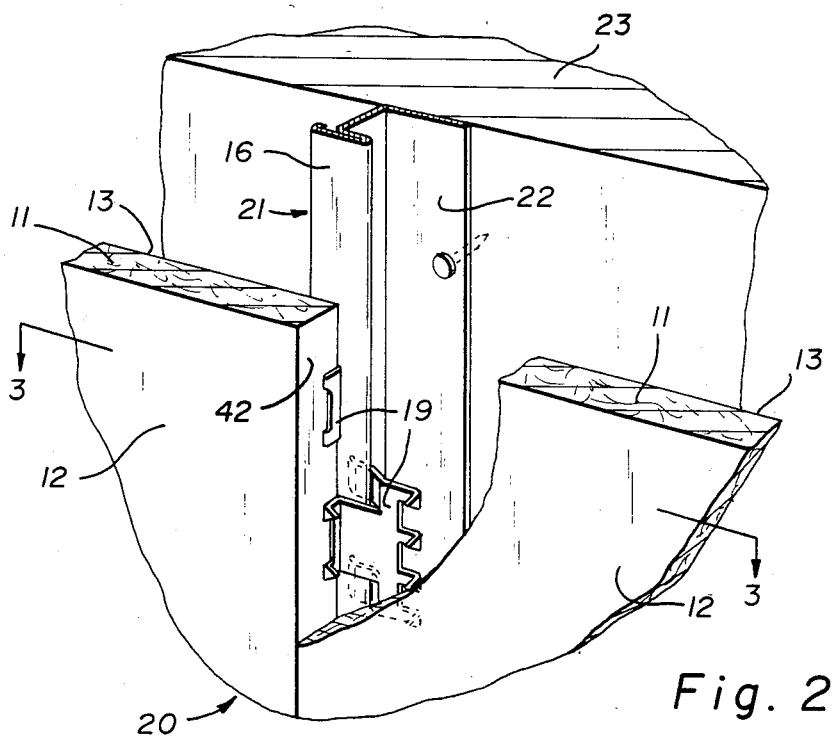
FIG. 2 is a perspective view of a portion of a perimeter wall construction having two panels at a joint with a "Z"-spline flange subjacent thereto.

Referring to FIG. 2, a typical perimeter wall is shown at a panel joint location partially broken away to illustrate the preferred embodiment of the invention. Perimeter wall 20 comprises a single row of panels 11 having exterior surfaces 12 providing the exposed area toward the room side and having interior or occluded surfaces 13 facing the perimeter wall generally composed of concrete, brick or other masonry, or less commonly, a wooden exterior wall. FIG. 2, shows stud flange edge clips 19 in demountable and relocatable assembly upon flange 16 of "Z"-shaped stud 21, which is in turn fixedly attached to the perimeter wall generally by attachment means which pierce both perimeter wall flange 22 and the perimeter wall. Although not illustrated in FIG. 2, an "H"-shaped stud may be used as subjacent support for panels 11 with like effect, although with less attention to economy of installation. Whether provided in a "Z"-shaped or as an "H"-shaped subjacent support stud, stud 21 is provided with flanges 16 and 22 parallel to the perimeter wall and to the wall panel, the former being immediately subjacent to wall panels 11 and the latter being in immediate juxtaposition to perimeter wall 23. The erection of perimeter wall 20 is similar to, and somewhat simpler than, the assembly of a partition wall 10 in FIG. 1 and is undertaken as described in FIG. 1. That is, when only edge attachment clips 19 need be used, either the dimensions, weight or bulk of panels 11 indicating no need for attachment to other than subjacent studs at the edge thereof, than clips 19 are attached at appropriate intervals to the edge 42 of panels 11, the planar portion 30 of each clip being in immediate juxtaposition with the occluded surface 13 of the panels, and the edge impaling points 33 being driven into the panel edge, impaling the points therein. The impaling points 33 of stud clip 19 which are now perpendicular to the occluded surface 13 of panel 11 are impaled therein to fixedly attach the clip to panel 11. Assembly may now be affected by slidably engaging the arcuate flange attachment portion 32 of the clips onto the leading flange 16 of a first stud, attaching the other edge similarly furnished with completely impaled clips by first slidably engaging the trailing edge of a flange of a second stud 21 with the flange attachment means of the clips and then secondly fixedly attaching the second stud to the perimeter wall. Should the dimensions, weight or bulk of panel 11 indicate that edge support alone would be inadequate and that adjacent support studs intermediate the edge studs would be required for adequate support, then intermediate attachment clips 19' may be fixed in vertical array upon the occluded surface of panel 11 spaced-apart from the on-center dimension of the spacing between the intermediate studs.

Referring to FIG. 3 there is illustrated in top sectional view the use of stud panel edge attachment clips 19 in the furring embodiment shown in perspective in FIG. 2. The panel edge attachment clips 19 are shown in finished or driven condition, impaled into the occluded surface 13 of adjacent panels 11. FIG. 3 further illustrates the ease of demounting and reinstalling individual panels 11 from subjacent studs 21; the application of vertical force to panels 11, that is, force seen as applied upwardly and perpendicularly to the plane of the drawing, will allow for the ready demounting of panels 11 from studs 21 when panels 11 and studs 21 are less than one half the floor to ceiling height of the wall upon which they are installed.

Referring to FIG. 4 there is illustrated the panel edge attachment clip 19 in perspective view showing the elements which allow the demounting and relocation of wall panels in perimeter interior wall installation in which the clip is used. Parallel to planar portion 30 of clip 19 are panel edge impaling points 31 mounted on a perpendicular flange 34. When planar portion 30 is in immediate juxtaposition with respect to the occluded surface 13 of panel 11 arranged to be installed in perimeter wall 20, a blow by hammer or otherwise to the flange 34 causes the edge impaling points 31 parallel to planar portion 30 to be impaled into the edge 42 of panel 11. Upon the impalement of the impaling points 31 into the edge 42 of the panel, complete securement of clip 19 to panel 11 is accomplished by additionally impaling impaling points 33 into the occluded surface 13 of the panel 11. The configuration of the driven or finished impaling point attachment means may be seen most clearly with further reference to FIG. 3, which illustrates that the pointed tips of the impaling points 33 are more proximate to the edge of panel 11 than the intersection of the impaling points with intermediate attachment means or fingers 35 securing the impaling points to the planar portion 30. The fingers 35 are disposed at an obtuse angle with respect to the planar portion 30. The impaling points 33 are disposed at an angle and preferrably at an acute angle with respect to the fingers 35. It is readily apparent from FIG. 3 that intermediate attachment fingers 35 become essentially coplanar with planar portion 30 when clip 19 is fully and securely attached to panel 11, that is, after the complete impalement of first impaling points 31 and second impaling points 33 into the edge and into the occluded surface adjacent the edge of the wall panel to provide the finished or driven position of clip 19 ready for mounting upon a subjacent spline or stud flange. In the installation of a panel 11 having an appropriate number of clips 19 securely affixed to the edge thereof, spline or stud flange attachment means 32 enters into sliding frictional engagement with the surface of the spline or flange opposite the surface of the spline or flange proximal to and in immediate juxtaposition with the planar portion 30 of clip 19 to thereby effect the secure mounting of panel 11 upon subjacent spline or stud support 16. When panels 11 are thus installed in perimeter panel wall 20, interior or occluded surface 13, and most particular exterior surface 12, that surface facing the interior of room, remain free of the surface delamination known in the art as "pooching", which is the formation of a blister or bubble in the laminar layers of surfaces 12 and 13 caused either by the impaling tines or prongs of prior art clips diverging toward either surface 12 or 13 of panel 11 upon impalement into the edge thereof, or by the fracture or disrupture and displacement toward the laminar layers of surfaces 12 or 13 of the material of construction of the wall panel by the impaling points.

Referring to FIGS. 5, 6, 7 and 8, there are shown, respectively, an elevational view from the proximal aspect of the occluded surface impaling points, a side elevational view, and elevational view from the proximal aspect of driving surface 34, and a plan view of the bottom of clip 19. The views, taken together, further illustrate the advantages and the freedom from the disadvantages of the prior art of the panel mounting clip 19 of this invention.

Figure 9:
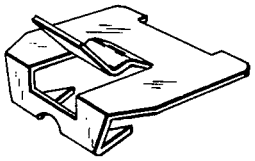
FIGS. 9 and 10 are wall panel attachment clips disclosed in the prior art and comprised of spring steel.
Figure 10:
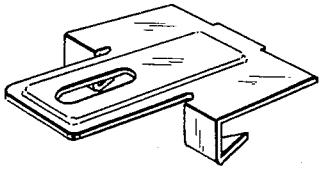

Referring to FIGS. 9 and 10, there are shown panel mounting clips known in the prior art. The impaling points of the prior art clips are about three times the size of the impaling points of the present clips, since the edge clips of the prior art clips are the only means of affixation, while the present clips have both edge impaling points and face impaling points. The large impaling points of the prior art cause core fracture and "pooching".

While the present invention has been disclosed in the light of specific embodiments thereof, it is evident that many alternatives, modifications, and variations may be readily apparent to one skilled in the art in the light of the foregoing description. Accordingly, this disclosure is intended to embrace all such alternatives, modifications and variations as may fall within the spirit and scope of the invention as defined in the following appended claims.

The invention is claimed as follows:

1. An integral clip for attaching wall panels having surfaces and vertical edges to supporting studs having flanges adapted to be positioned subjacent and parallel to and in engagement with the surfaces of said wall panels, said clip comprising:

a substantially planar portion adapted to be positioned in immediate juxtaposition with the surface of one of said wall panels adjacent to the edge thereof to be attached to said flanged stud;

an attachment flange depending from an edge of said planar portion and substantially perpendicular thereto, having impaling points at the edge thereof, the impaling points being substantially parallel to said planar portion;

stud flange attachment means comprising spaced-apart clip members integral with and struck one on each side from said planar portion and extending therefrom and leaving an intermediate portion intermediate said clip members, the portion of said planar portion intermediate said clip members supporting said attachment flange, said clip members being generally arcuately formed for receiving and frictionally engaging a flange of said stud, and impaling point-supporting fingers extending from said planar portion at an obtuse angle thereto and having impaling points at the ends of said fingers adapted to be impaled into the surface of said panel.

2. A clip according to claim 1, wherein said impaling points at the ends of said impaling point-supporting fingers are disposed at an acute angle with respect to said fingers.

3. A clip according to claim 1 wherein said stud flange attachment clip members each have an up-turned end adapted to facilitate engagement with the flange of a stud.

4. Construction comprising vertically mounted supporting studs having flanges, wall panels having surfaces and vertical edges mounted in engagement with the flanges of said studs, and integral clips attaching the edges of said wall panels to the flanges of said studs, said integral clips each comprising:

a substantially planar portion positioned in immediate juxtaposition with a surface of one of said wall panels adjacent to the edge thereof attached to said flanged stud;

an attachment flange depending from an edge of said planar portion and substantially perpendicular thereto, having impaling points at the edge thereof, the impaling points being substantially parallel to said planar portion and being impaled in the edge of a wall panel;

stud flange attachment means comprising spaced-apart clip members integral with and struck one on each side from said planar portion and extending therefrom and leaving a portion intermediate said clip members, the portion of said planar portion intermediate said clip members supporting said attachment flange, said clip members being generally arcuately formed for receiving and frictionally engaging a flange of said stud, and impaling point-supporting fingers extending from said planar portion having impaling points at the ends of said fingers impaled into a surface of said panel.

5. Construction according to claim 4, wherein said impaling points at the ends of said impaling point-supporting fingers are disposed at an acute angle with respect to said fingers.

6. Construction according to claim 4 wherein said stud flange attachment clip members have an up-turned end adapted to facilitate engagement with the flange of said stud.

* * * * *